United States Patent [19]

Lees et al.

[11] Patent Number: 4,609,605

[45] Date of Patent: Sep. 2, 1986

[54] MULTI-LAYERED IMAGING MEMBER COMPRISING SELENIUM AND TELLURIUM

[75] Inventors: Barry A. Lees, Fairport; Robert J. Flanagan, Macedon; Monroe J. Hordon, Pittsford, all of N.Y.

[73] Assignee: Xerox Corporation, Stamford, Conn.

[21] Appl. No.: 707,978

[22] Filed: Mar. 4, 1985

[51] Int. Cl.[4] ..... G03G 5/082; G03G 5/09

[52] U.S. Cl. ..... 430/58; 430/65; 430/95; 430/85

[58] Field of Search ..... 430/57, 58, 65, 95, 430/85

[56] References Cited

U.S. PATENT DOCUMENTS

| | | | |
|---|---|---|---|
| 2,803,541 | 8/1957 | Paris | 96/1 |
| 2,962,376 | 11/1960 | Schaffert | 96/1 |
| 3,041,166 | 6/1962 | Bardeen | 96/1 |
| 3,312,548 | 4/1967 | Straughan | 96/1.5 |
| 3,467,548 | 9/1969 | Straughan | 117/217 |
| 3,635,705 | 1/1972 | Ciuffini | 96/1.5 |
| 3,639,120 | 2/1972 | Snelling | 96/1.5 |
| 3,655,377 | 4/1972 | Sechak | 96/1.5 |
| 3,861,913 | 1/1975 | Chiou | 96/1.5 |
| 3,901,703 | 8/1975 | Baum | 96/1.5 |
| 4,170,476 | 10/1979 | Sadamatsu et al. | 96/1.5 |
| 4,226,929 | 10/1980 | Teshima et al. | 430/57 |
| 4,286,033 | 8/1981 | Neyhart et al. | 430/58 |
| 4,296,191 | 10/1981 | Jacobson et al. | 430/57 |
| 4,297,424 | 10/1981 | Hewitt | 430/58 |
| 4,338,387 | 7/1982 | Hewitt | 430/58 |
| 4,490,451 | 12/1984 | Baumgaertner et al. | 430/57 |

FOREIGN PATENT DOCUMENTS

| | | |
|---|---|---|
| J56142-537 | 11/1981 | Japan . |
| 58-100854 | 6/1983 | Japan . |
| 1530355 | 4/1975 | United Kingdom . |
| 1578960 | 11/1980 | United Kingdom . |

OTHER PUBLICATIONS

"Charge Transport in Selenium Based Amorphous Xerographic Photoreceptors," S. D. Kasap et al. Photographic Science & Eng., vol. 26, No. 5, Sep./Oct. 1982, pp. 239–244.

"Photoreceptor for LED Printer," K. Tateishi et al., Kenkyu Jitsuyoka Hokoku (E.C.L. Tech. Jour.) NTT Japan, vol. 31, No. 3, pp. 597–604 (1982).

"A Highly Sensitive Chalcogenide Photoconductor in a Near-Infrared Wavelength Region,38 U. Taniguchi et al., J. Appl. Phys. 52(12), (Dec. 1981), pp. 7261–7269.

U.S. Ser. Nos. 619,247, 619,109, Foley et al., filed Jun. 11, 1984.

*Primary Examiner*—John D. Welsh

*Attorney, Agent, or Firm*—Peter H. Kondo

[57] ABSTRACT

An electrophotographic imaging member is disclosed consisting essentially of a supporting substrate, a charge transport layer substantially free of arsenic and tellurium and consisting essentially of selenium and a halogen selected from the group consisting of from about 4 parts per million by weight to about 13 parts per million by weight of chlorine and from about 8 parts per million by weight to about 25 parts per million by weight of iodine and a photoconductive charge generator layer comprising selenium, from about 5 percent to about 20 percent by weight tellurium, from about 0.1 percent to about 4 percent by weight arsenic, and a halogen selected from the group consisting of up to about 70 parts per million by weight of chlorine and up to about 140 parts per million by weight of iodine, one surface of the charge generator layer being in operative electrical contact with the charge transport layer and the other surface of the charge generator layer being exposed to the ambient atmosphere. This electrophotographic imaging member may be employed in a process involving depositing a substantially uniform positive electrostatic charge on the exposed surface of the photoconductive charge generator layer of the electrophotographic imaging member, exposing the electrophotographic imaging member to an imagewise pattern of electromagnetic radiation to which the selenium-tellurium-arsenic alloy photoconductive charge generating layer is responsive whereby an electrostatic latent image is formed on the electrophotographic imaging member, developing the electrostatic image with electrostatically attractable toner particles to form a toner particle deposit in image configuration, and transferring the toner particle deposit to a receiving member. The process may be repeated numerous times in an automatic device.

10 Claims, 2 Drawing Figures

MULTI-LAYERED IMAGING MEMBER COMPRISING SELENIUM AND TELLURIUM

BACKGROUND OF THE INVENTION

This invention relates in general to an electrophotographic imaging system, and more specifically, to electrophotographic imaging members containing two selenium containing layers and a method of utilizing such members.

The formation and development of images on the imaging surfaces of electrophotographic imaging members by electrostatic means is well known. One of the most widely used processes being xerography described, for example, in U.S. Pat. No. 2,297,691 to Chester Carlson. Numerous different types of photoreceptors can be used in the electrophotographic imaging process. Such electrophotographic imaging members may include inorganic materials, organic materials, and mixtures thereof. Electrophotographic imaging members may comprise contiguous layers in which one of the layers performs a charge generation function and the other layer performs a charge carrier transport function or may comprise a single layer which performs both the generation and transport functions.

Electrophotographic imaging members based on amorphous selenium have been modified to improve panchromatic response, increase speed and to improve color copyability. These devices are typically based on alloys of selenium with tellurium. The selenium electrophotographic imaging members may be fabricated as single layer devices comprising a selenium-tellurium alloy layer which performs both charge generator and charge transport functions. the selenium electrophotographic imaging members may also contain multiple layers such as, for example, a selenium alloy transport layer and a contiguous selenium-tellurium alloy generator layer. These multiple layer electrophotographic imaging members containing a selenium-tellurium alloy generator layer are characterized by varying degrees of electrical instability during cycling. For example, multiple layer electrophotographic imaging members containing a selenium-tellurium alloy generator layer containing about 10 percent by weight tellurium and a selenium-arsenic alloy transport layer exhibit significant levels of residual cycle-up which may be further agravated by cycle rate, thermal cycling at elevated temperatures and by undesirable interactions with lamps and corotrons adjacent the electrophotographic imaging member. The addition of arsenic to a generator layer composition of selenium-tellurium can increase photoreceptor life about 1.5 to about 2 times that of a generator layer composition containing only selenium-tellurium. When arsenic is added to a generator layer composition of selenium-tellurium, the crystalization resistance of the electrophotographic imaging member is increased. These electrophotgraphic imaging members exhibit increased life under conditions of high humidity and/or high temperature which usually promote crystallization of a non-arsenis bearing selenium alloy layer. Such crystallization problems are particularly accute in office buildings in tropical regions where the office buildings are not air conditioned or where the air conditioning is turned off in the evening to conserve energy. However, addition of arsenic to a generator layer containing selenium-tellurium generally produces an increase in residual potentials and residual cycle-up. Residual cycle-up is the cumulative development of increasing levels of residual voltage with cycling. Residual voltage is that potential measured at the surface of the photoreceptor following photodischarge of the photoreceptor by high levels of light exposure during the erase cycle. The residual voltage is a reflection of the existence of positive charge (in the case of a positive charging system) trapped in the bulk of the photoconductive layers or at interfaces between layers in a photoconductive device. The rate of residual cycle-up and its ultimate saturation value is generally observed to increase with increasing cycle rate. Equilibration of the photoreceptor at temperatures above room temperature either during photoreceptor storage or during machine operation also generally leads to a temporary enhancement of residual cycle-up, both its rate of increase and its saturation value. Similarly, exposure of electrophotographic imaging members containing a selenium-tellurium alloy generator layer to radiation in the 600 to 700 nanometer range, e.g. light from tungsten or fluorescent room lights, during installation of the imaging member in a copier, duplicator or printer can cause a marked increase in cycle-up during subsequent use due to bulk absorbed radiation. More specifically, the presence of an arsenic concentration in both the transport and generator layers can lead to arsenic diffusive transport across the boundary between the transport layer and generator layer thereby producing extensive charge trapping. Such trapping can induce enhanced potential dark decay which in turn induces copy quality degradation evidenced by positive ghost image formation. Ghost imaging is the retention of an image from a prior copy cycle.

SUMMARY OF THE INVENTION

It is, therefore, an object of the present invention to provide an imaging system which overcomes the above-noted disadvantages.

It is another object of this invention to provide an electrophotographic imaging member which resists cycle-up under thermal cycling.

It is another object of this invention to provide an electrophotographic imaging member which resists cycle-up under rapid cycling.

It is another object of this invention to provide an electrophotographic imaging member which resists cycle-up during cycling after exposure to uniform illumination.

It is still another object of the present invention to provide an electrophotographic imaging member which minimizes cycle-down in background potential during cycling while exhibiting low residual cycle-up.

It is another object of this invention to provide an electrophotographic imaging member which resists crystalization including under conditions of high humidity and/or high temperature.

It is another object of this invention to provide an electrophotographic imaging member which utilizes only two selenium containing layers.

It is another object of this invention to provide an electrophotographic imaging member which reduces photoreceptor surface wear and erosion.

The foregoing objects and others are accomplished in accordance with this invention by providing an electrophotographic imaging member consisting essentially of a supporting substrate, a charge transport layer having a thickness of between about 35 micrometers and about 75 micrometers substantially free of arsenic and tellurium and consisting essentially of selenium and a halogen selected from the group consisting of from about 4 parts per million by weight to about 13 parts per million by weight of chlorine and from about 8 parts per million by weight to about 25 parts per million by weight of iodine and a photoconductive charge generator layer having a thickness of between about 1 micrometer and about 20 micrometers comprising from about 5 percent to about 20 percent by weight tellurium, from about 0.1 percent to about 4 percent by weight arsenic, a halogen selected from the group consisting of up to about 70 parts per million by weight of chlorine and up to about 140 parts per million by weight of iodine and the remainder selenium, one surface of the charge generator layer being in operative electrical contact with the charge transport layer and the other surface of the charge generator layer being exposed to the ambient atmosphere. This electrophotographic imaging member may be employed in a process involving despositing a substantially uniform positive electrostatic charge on the exposed surface of the photoconductive charge generator layer of the electrophotographic imaging member, exposing the electrophotographic imaging member to an imagewise pattern of electromagnetic radiation to which the selenium-tellurium-arsenic alloy photoconductive charge generating layer is responsive whereby an electrostatic latent image is formed on the electrophotographic imaging member, developing the electrostatic image with electrostatically attractable toner particles to form a toner particle deposit in image configuration and transferring the toner particle deposit to a receiving member. The process may be repeated numerous times in an automatic device.

The substrate may be opaque or substantially transparent and may comprise numerous suitable materials having the required mechanical properties. The entire substrate may comprise the same material as that in the electrically conductive surface or the electrically conductive surface may merely be a coating on the substrate. Any suitable electrically conductive material may be employed. Typical electrically conductive materials include, for example, aluminum, titanium, nickel, chromium, brass, stainless steel, copper, zinc, silver, tin and the like. The conductive layer may vary in thickness over substantially wide ranges depending on the desired use of the electrophotoconductive member. Accordingly, the conductive layer may generally range in thickness from about 50 Angstrom units to many centimeters. When a flexible electrophotographic imaging member is desired, the thickness may be between about 100 Angstrom units to about 750 Angstrom units. The substrate may comprise any other conventional material including organic and inorganic materials. Typical substrate materials include insulating non-conducting materials such as various resins known for this purpose including polyesters, polycarbonates, polyamides, polyurethanes, and the like. The coated or uncoated substrate may be flexible or rigid and may have any number of configurations such as, for example, a plate, a cylindrical drum, a scroll, an endless flexible belt, and the like. The outer surface of the supporting substrate adjacent to the charge transport layer should normally comprise a metal oxide such as aluminum oxide, nickel oxide, titanium oxide, and the like.

In some cases, intermediate adhesive layers between the metal oxide surface and subsequently applied layers may be desirable to improve adhesion. If such adhesive layers are utilized, they preferably have a dry thickness between about 0.1 micrometer to about 5 micrometers. Typical adhesive layers include film-forming polymers such as polyester, polyvinylbutyral, polyvinylpyrolidone, polyurethane, polymethylmethacrylate, and the like and mixtures thereof.

The charge transport layer consists essentially of selenium and a critical amount of halogen selected from the group consisting of chlorine and iodine. The charge transport layer should be substantially free of arsenic and tellurium to minimize high residual voltage and high background cycle-up behavior. The substantial elimination of arsenic and tellurium in the transport layer also eliminates concentration build-up of these elements due to evaporative fractionation at the layer interface. Excessive fractionation effects can induce high charge trapping. Since trace amounts of arsenic and tellurium may be present in selenium even after refining, the expression "substantially free of arsenic and tellurium" is intended to mean that the transport layer contains less than about 100 parts per million by weight arsenic and less than about 500 parts per million tellurium based on the weight of selenium. The charge transport layer substantially free of arsenic and tellurium should consist essentially of a halogen selected from between about 4 parts per million by weight to about 13 parts per million by weight of chlorine or from about 8 parts per million by weight to about 25 parts per million by weight of iodine with the remainder being selenium. When the concentration of chlorine is below about 4 parts per million by weight, residual potential and residual cycle-up become unduly high. Also, xerographic background potential cycle-up becomes excessive. Concentrations of chlorine exceeding about 13 parts per million by weight lead to excessive dark decay. For optimum results, the transport layer should contain between about 6 parts per million by weight to about 10 parts per million by weight of chlorine or between about 13 parts per million by weight to about 20 parts per million by weight of iodine. These halogen concentrations are the concentrations of halogen in the transport layer after deposition. The halogen concentration in the deposited transport layer is less than the halogen concentration in the alloy in the crucible prior to evaporation, i.e. the "nominal concentration". The chlorine concentration in the deposited transport layer will normally be about 25 to 35 percent by weight less than that in the alloy evaporated in the crucible. In other words, the chlorine concentration in the deposited transport layer is generally about 65 to 75 percent of the halogen concentration in the halogen doped alloy in the crucible prior to evaporation. The expression "halogen" as employed herein is intended to include chlorine and iodine. Chlorine is preferred because of the ease of handling and the stability of chlorine in the film (apparenty due to lack of diffusion). The thickness of the charge transport layer is generally between about 35 micrometers and about 75 micrometers. If the thickness of the charge transport extends below about 35 micrometers, the dark development potential ($V_{ddp}$) of the photoreceptor diminishes and poor solid area reproduction is observed. If the thickness of the charge transport exceeds about 75 micrometers, carrier bead carryover, print deletion, and damage to the photoreceptor and other machine components is likely to occur.

The transport layer can be deposited by any suitable conventional technique, such as vacuum evaportion. Thus a charge transport layer consisting essentially of halogen doped selenium may be evaporated by conventional vacuum coating devices to form the desired thickness. The amount of halogen doped selenium to be employed in the evaporation boats of the vacuum coater will depend on the specific coater configuration and other process variables to achieve the desired transport layer thickness. The halogen doped selenium loaded into the evaporation crucible is normally in the form of shot having an average article size of about 2 millimeters. Chamber pressure during evaporation may be on the order of less than about $4\times10^{-5}$ Torr. Evaporation is normally completed in about 15 to 55 minutes with the molten alloy temperature ranging from about 250° C. to about 325° C. Other times and temperatures outside these ranges may be used as well understood by those skilled in the art. It is generally desirable that the substrate temperature be maintained in the range of from about 50° C. to about 95° C. during deposition of the transport layer. The halogen doped selenium material employed in the transport layer may be efficiently deposited in conventional planetary coating systems by depositing the selenium alloy generator layer subsequent to depositing the transport layer material without removing the substrate and without breaking the vacuum in the planetary coater. Sequential deposition of selenium containing layers is well known in the art and conventional techniques such as the use of shuttered evaporation crucibles, breaking of the vacuum to permit charging of the coating chamber with the second coating material, and the like may be utilized, if desired. Additional details for the preparation of transport layers are disclosed, for example, in U.S. Pat. No. 4,297,424 to H. Hewitt, the entire disclosure thereof being incorporated herein by reference.

The charge transport layer is positioned between the supporting substrate and the charge generating selenium-tellurium-arsenic photoconductive alloy layer. Since the surface of the supporting substrate may be a metal oxide layer or an adhesive layer, the expression "supporting substrate" as employed herein is intended to include a metal oxide layer with or without an adhesive layer on a metal oxide layer.

The photoconductive charge generating selenium-tellurium-arsenic alloy layer should comprise between about 5 percent by weight and about 20 percent by weight tellurium, between about 0.1 percent by weight and about 4 percent by weight arsenic, a halogen selected from the group consisting of up to about 70 parts per million by weight of chlorine and up to about 140 parts per million by weight of iodine with the remainder being selenium. The expresion "selenium-tellurium-arsenic alloy" is intended to include halogen doped alloys as well as alloys not doped with halogen. Optimum results are achieved with charge generation layers containing between about 10 percent by weight and about 13 percent by weight tellurium, between about 0.5 percent by weight and about 2 percent by weight arsenic and less than about about 15 parts per million by weight chlorine with the remainder being selenium. Concentrations of tellurium exceeding about 20 percent by weight lead to excessive photoreceptor light sensitivity and high dark decay and concentrations of tellurium less than about 5 percent by weight results in low light sensitivity and loss of copy quality. When the concentration of arsenic exceeds about 4 percent by weight, the photoreceptor experiences excessive dark decay. The resistance of amorphous selenium photoreceptors to thermal crystallization and surface wear begins to degrade as the concentration of arsenic drops below about 0.1 percent by weight. As the chlorine content rises above about 70 parts per million by weight chlorine, the photoreceptor begins to exhibit excessive dark decay.

The selenium-tellurium-arsenic alloy generating layer can be prepared in one preferred embodiment by grinding selenium-tellurium-arsenic alloy shot, with or without halogen doping, preparing pellets having an average diameter of about 6 millimeters from the ground material, and evaporating the pellets in crucibles in a vacuum coater using a time/temperature crucible designed to minimize the fractionation of the alloy during evaporation. In a typical crucible evaporation program, the generating layer is formed in about 12 to about 30 minutes during which time the crucible temperature is increased from about 20° C. to about 385° C. Additional details for the preparation of generating layers are disclosed, for example, in U.S. Pat. No. 4,297,424 to H. Hewitt, the entire disclosure thereof being incorporated herein by reference.

Satisfactory results may be achieved with a selenium-tellurium-arsenic alloy photoconductive generating layer having a thickness between about 1 micrometer and about 20 micrometers. The selenium-tellurium-arsenic alloy of photoreceptor of this invention provides all the required photographic responses as well as extending photoreceptor life. Selenium-tellurium-arsenic alloy generating layers having a thickness greater than about 20 micrometers generally induce excessive arsenic and tellurium fractionation control difficulties during photoreceptor fabrication. Thicknesses less than about 1 micrometer tend to wear too rapidly in automatic electrophotographic copiers, duplicators and printers. Optimum results are achieved with generating layers laving a thickness between about 3 micrometers and about 7 micrometers.

BRIEF DESCRIPTION OF THE DRAWINGS

A more complete understanding of the process and device of the present invention can be achieved by reference to the accompanying drawings wherein.

Figure 1:
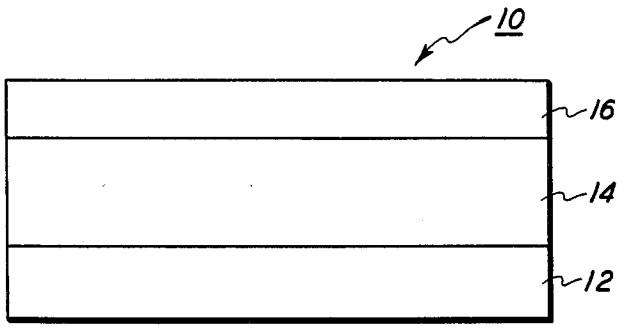
FIG. 1 graphically illustrates a typical prior art multilayered photoreceptor comprising a charge generating layer and a transport layer supported on a conductive substate.

Refering to FIG. 1 an electrophotographic imaging member 10 of the prior art is illustrated comprising a substrate 12, a transport layer 14 comprising a halogen doped selenium-arsenic alloy layer and a generating layer 16 comprising an alloy of selenium.

The substrate 12 may comprise any suitable material having the required mechanical properties. Typical substrates include aluminum, nickel and the like. The thickness of the substrate layer is dependent upon many factors including economic considerations, design of the device in which the electrophotographic imaging is to be used, and the like. Thus, the substrate may be of substantial thickness, for example, up to about 5,000 micrometers, or of minimum thickness such as about 100 micrometers. The substrate may be flexible or rigid and may have different configurations as described above.

The transport layer 14 comprises a halogen doped selenium-arsenic alloy, however, an undoped alloy may also be used. The percent of selenium present in this alloy may range from about 99.5 percent to about 99.9 percent by weight and the percentage of arsenic present may range from about 0.1 percent by weight to about 0.5 percent by weight. The amount of halogen such as chlorine, fluorine, iodine or bromine present in the doped alloy layer may range from about 10 parts be weight per million to about 200 parts by weight per million with the preferred range being from about 20 parts by weight per million to about 100 parts by weight per million. The preferred halogen is chlorine. This layer generally ranges in thickness from about 15 micrometers to about 75 micrometers and preferably from about 25 micrometers to about 50 micrometers because of constraints imposed by the xerographic development system, constraints imposed by carrier transport limitations and for reasons of economics.

The charge generating layer 16 comprises charge generating selenium-tellurium alloy photoconductive material such as selenium-tellurium alloys, selenium-tellurium alloys doped with halogen, selenium-tellurium-arsenic alloys, selenium-tellurium-arsenic-halogen alloys, and the like. Excellent results may be achieved with alloys of selenium and tellurium. Generally, the selenium-tellurium alloy may comprise from about 55 percent by weight to about 95 percent by weight selenium and from about 5 percent by weight to about 45 percent by weight tellurium based on the total weight of the alloy. The thickness of the generator layer is generally less than about one micrometer when the tellurium content is about 40 percent. The selenium-tellurium alloy may also comprise other components such as less than about 5 percent by weight arsenic to minimize crystallization of the selenium and less than about 1000 parts per million by weight halogen.

Figure 2:
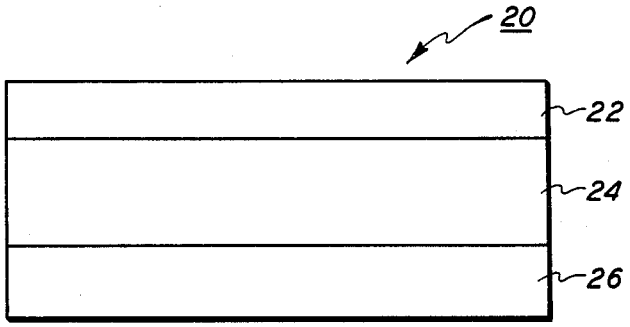
FIG. 2 graphically illustrates a layered photoreceptor of this invention comprising a charge generating layer and a hole injecting layer supported on a conductive substrate.

Referring to FIG. 2, an electrophotographic imaging member 20 is depicted comprising a charge generating photoconductive layer 22 and a charge transport layer 24. The charge transport layer 24 is supported on a metal oxide layer 26. The principal differences between electrophotographic imaging member of FIG. 1 and that of FIG. 2 are the absence of arsenic and the critical range of halogen in the transport layer 24 shown in FIG. 2. Effects such as residual voltage cycle-up due to cycle rate, thermal cycling at elevated temperatures and undesirable interactions with lamps and corotrons around the electrophotographic imaging member following repeated uniform charging, imagewise exposure, development, transfer, erase and cleaning cycles are significantly different between the electrophotographic imaging member shown in FIG. 1 and the electrophotographic imaging member shown in FIG. 2. This difference is illustrated in greater detail in the working examples that follow.

Any suitable development technique may be utilized to develop the electrostatic latent image on the electrophotographic imaging member of this invention. Typical well known electrophotographic development techniques include, for example, cascade development, magnetic brush development, liquid development, powder cloud development and the like. The deposited toner image may be transferred to a receiving member by any suitable conventional transfer technique and affixed to the receiving member by any suitable well known fixing technique. While it is preferably to develop electrostatic latent image with toner particles, the electrostatic latent image may be employed in a host of other ways such as, for example, "reading" the electrostatic latent image with an electrostatic scanning system. Cleaning of the photoreceptor to remove any residual toner particles remaining after transfer may be effected by any suitable conventional cleaning technique such as brush cleaning, blade cleaning, web cleaning and the like.

Erasure of the electrostatic latent image may be accomplished by any suitable conventional technique. Typical conventional erase techniques include AC corona discharge, negative corona discharge, illumination from a light source, contact with a grounded conductive brush, and combinations thereof. However, the imaging member of this invention is particularly suitable for imaging systems in which the imaging member is exposed to a source of light having a wavelength to which the generator layer is sensitive, e.g. pretransfer light, erase light, fuser radiation leakage and the like which discharges the imaging member to residual potential each copy cycle. If discharge to residual potential by exposure to light occurs during each copy cycle, residual cycle-up is greatly increased with the multilayered selenium-tellurium-arsenic imaging members of the type illustrated in FIG. 1.

Residual cycle-up due to cycle rate, thermal cycling at elevated temperatures and undesirable interactions with lamps and fusers around the electrophotographic imaging member is highly undesirable in precision, low and high speed electrophotographic copiers, duplicators and printers because such cycle-up ultimately appears as toner development in areas of a copy corresponding to the background areas of the original document and therefore results in "dirty" copies.

The invention will now be described in detail with respect to specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

Control electrophotographic imaging members were prepared by evaporating halogen doped selenium-arsenic alloy shot containing about 0.5 percent by weight arsenic, about 99.5 percent by weight selenium and about 20 parts per million by weight chlorine onto a substrate to form a chlorine doped selenium-arsenic charge transport layer. This chlorine doped selenium-arsenic alloy was evaporated from stainless steel crucibles at an evaporation temperature of between about 280° C. and about 330° C. and an evaporation pressure between about $4\times10^{-4}$ torr and $2\times10^{-5}$ torr. The substrate utilized was a nickel cylinder that had been thermally oxidized to grow an outer nickel oxide layer having a thickness between about 500 Angstroms and about 800 Angstroms. The diameter of the nickel cylinder was about 8.4 centimeters. The substrate temperature was maintained between about 50° C. and about 95° C. during this evaporation coating operation. The resulting arsenic halogen doped selenium transport layer had a thickness of about between about 55 micrometers and about 60 micrometers and contained about 0.5 percent by weight arsenic, about 99.5 percent by weight selenium and about 14 parts per million by weight chlorine. This coated substrate was thereafter coated with a selenium-tellurium-arsenic alloy to form a charge generating photoconductive layer having a thickness of about 5 micrometers and containing between about 12 percent and about 13 percent by weight tellurium, about 1 percent by weight arsenic and the remainder selenium. This alloy was evaporated at a temperature of between about 300° C. and about 350° C. from the stainless steel crucibles at a pressure of about $2\times10^{-5}$ torr. Since neither the selenium-tellurium-arsenic alloy material prior to evaporation nor the selenium-tellurium-arsenic alloy material subsequent to deposition contained halogen, both alloy materials contained the same concentration of components. The resulting electrophotographic imaging members were tested in a test fixture which cycled the imaging members at a surface speed of about 13.9 cm/sec. The imaging members were first charged in the dark to a positive potential between about 900–1100 volts and exposed to an exposure source having spectral output in the blue region of the visible spectrum (about 470 nm) to reduce the potential to about 200 volts. Since the charge current was set prior to this test, the positive potential voltage acceptance levels were dependent upon the thickness of the imaging members. The variation in initial positive potential acceptance voltage of a typical imaging member may vary from about 0–20 volts. A charge acceptance voltage range of about 900 to 1100 volts will provide good performance in automatic copiers. This range of positive potential voltages produces excellent solid area copy quality with no visible variation in density across the image for the first copy. The imaging members were then erased by uniform exposure to an array of neon lamps with a peak output in the green region (about 520 nm) of the visible spectrum. This process was repeated 330 times in an ambient room temperature environment and the residual voltage cycle-up at the end of the 330th cycle was determined by an electrostatic voltmeter. In this xerographic machine, each finished copy requires 3.3 revolutions or cycles of the cylindrical photoconductor. The average residual voltage cycle-up for these control imaging members was 160 volts. Voltage cycle-up exceeding about 100 volts is undesirable in automatic electrophotographic copiers, duplicators and printers because of the excessive variation in copy uniformity over many cycles. In other words, the 100th copy should exhibit substantially the same image quality as the first copy.

EXAMPLE II

Electrophotographic imaging members of this invention were prepared by evaporating a chlorine doped selenium composition to form a chlorine doped transport layer from stainless steel crucibles. Except for the composition of the transport material evaporated, the evaporation procedures employed to deposit the transport layer of this Example were identical to the procedures described in Example I. The transport material prior to evaporation contained about 10 parts per million by weight chlorine, less than 100 parts per million arsenic, and the remainder selenium. The resulting deposited halogen doped charge transport layer had a thickness of between about 55 micrometers and about 60 micrometers and contained about 7 parts per million by weight chlorine, less than 100 parts per million arsenic and the remainder selenium. This coated substrate was thereafter coated with a selenium-tellurium-arsenic alloy using evaporation procedures identical to the procedures described in Example I to form a photoconductive charge generating selenium-tellurium-arsenic layer having a thickness of about 5 micrometers and containing about 12 percent by weight and about 13 percent by weight tellurium, about 1 percent by weight arsenic and the remainder selenium. These photoreceptors containing 7 parts per million by weight chlorine in the deposited transport layer were then subjected to 330 imaging cycles as described in Example I. The residual voltage cycle-ups after the 330th cycle were less than 40 volts for the photoreceptors of this invention. Thus, the residual cycle-up for photoreceptors of control Example I were 300 percent greater than the residual voltage cycle-ups of the photoreceptors in this Example (II).

EXAMPLE III

The procedures of Example II were repeated to prepare additional control photoreceptors except that a chlorine doped selenium material comprising about 5 parts per million chlorine and the remainder selenium was used as the evaporant material to form a transport layer. The deposited transport layer had a thickness between about 55 micrometers and about 60 micrometers and contained about 3 parts per million chlorine and the remainder selenium. Materials and procedures identical to those described in Example II were used to prepare a photoconductive charge generating layer having a thickness of about 5 micrometers and containing about 12 percent by weight to about 13 percent by weight tellurium, about 1 percent by weight arsenic and the remainder selenium. These photoreceptors containing 3 parts per million by weight chlorine in the transport layer were subjected to the same test method described in Example I and Example II. The residual potentials initially were approximately 250 percent greater than the photoreceptor of Example II in which the transport layer was prepared from evaporant material containing 10 parts per million by weight chlorine. Residual voltage and cycle-up was similar to that exhibited by the photoreceptors of Example I with average residual cycle-up being about 159 volts.

EXAMPLE IV

The procedure of Example II was repeated to prepare additional photoreceptors except that a chlorine doped selenium transport layer having a thickness between about 55 micrometers and about 60 micrometers was prepared from an evaporant comprising 20 parts per million by weight chlorine and the remainder selenium. The deposited transport layer contained 14 parts per million by weight chlorine and the remainder selenium. Materials and procedures identical to those described in Example II were used to prepare a photoconductive charge generating layer having a thickness of about 5 micrometers and containing about 12 percent by weight to about 13 percent by weight tellurium, about 1 percent by weight arsenic and the remainder selenium. Results from subjecting this photoreceptor to the testing procedures described in Example I produced very low residual cycle up values of less than 30 volts. However, excessive dark decay and poor charge acceptance were observed for the samples. The photoreceptors of Example II in which the deposited transport layer contained 7 parts per million by weight chlorine accepted an initial positive charge between about 900 volts to about 1100 volts whereas the photoreceptor of this Example (IV) having a deposited transport layer containing 14 parts per million by weight chlorine accepted an initial positive charge on the average of less than about 730 volts. This poor charge acceptance will result in poor solid area density reproduction in a Xerox 2830 or Xerox 1035 Copier. Poor solid area density reproduction is defined as a solid area image having a value less than 1 as measured on a Macbeth RD517 Densitometer or exhibiting poor fill in of solid areas (e.g. a one inch diameter solid area would have dark edges but a washed out appearance in the center).

EXAMPLE V

The procedures described in Example I were repeated except that a chlorine doped selenium-arsenic charge transport layer was prepared from an evaporant containing about 0.1 percent by weight arsenic, about 99.9 percent by weight selenium and about 10 parts per million by weight chlorine was utilized to prepare additional control photoreceptors. The resulting halogen doped charge transport layer had a thickness of between about 55 micrometers and about 60 micrometers and contained about 99.9 percent by weight selenium, about 0.1 percent by weight arsenic, and about 7 parts per million by weight chlorine. Materials and procedures identical to those described in Example I were used to prepare a photoconductive charge generating layer having a thickness of about 5 micrometers and containing about 12 percent by weight to about 13 percent by weight tellurium, about 1 percent by weight arsenic and the remainder selenium. Results from testing employing the procedures described in Example I revealed a higher initial residual potential of approximately 25 volts greater than the residual potential for the photoreceptors of Example II which had a deposited transport layer containing 7 parts per million by weight chlorine and no arsenic prepared from evaporants containing 10 parts per million by weight chlorine and no arsenic. In addition, an increased of residual voltage cycle-up of about 70 volts over the residual voltage cycle-up for the photoreceptors of Example II was observed.

EXAMPLE VI

Electrophotographic imaging members of this invention were prepared by evaporating a selenium mixture containing 14 parts per million by weight chlorine and the remainder selenium onto a substrate to form a charge transport layer containing 10 parts per million by weight chlorine and the remainder selenium. This halogen doped selenium mateial was evaporated from stainless steel crucibles at an evaporation temperature of between about 280° C. and about 330° C. and an evaporation pressure between about $4\times10^{-4}$ torr and $2\times10^{-5}$ torr. The substrate utilized was a nickel cylinder that had been thermally oxidized to grow an outer nickel oxide layer having a thickness between about 500 Angstroms and about 800 Angstroms. The diameter of the nickel cylinder was about 8.4 centimeters. The substrate temperature was maintained at between about 55° C. and about 95° C. during this evaporation coating operation. The resulting deposited chlorine doped selenium transport layer had a thickness of about 55 micrometers and contained about 10 parts per million by weight chlorine and the remainder selenium. This coated substrate was thereafter coated with a selenium-tellurium-arsenic alloy to form a charge generating photoconductive layer having a thickness of about 5 micrometers and containing about 11 percent by weight tellurium, about 1 percent by weight arsenic and the remainder selenium. This alloy was evaporated at a temperature of between about 300° C. and about 350° C. from stainless steel crucibles at a pressure of about $2\times10^{-5}$ torr. Since neither the selenium-tellurium-arsenic alloy material prior to evaporation nor the selenium-tellurium-arsenic alloy material subsequent to deposition contained halogen, both alloy materials contained the same concentration of components. The resulting electrophotographic imaging members were tested in a test fixture which cycled the imaging members at a surface speed of about 13.9 cm/sec. The imaging members were first charged in the dark to a positive potential of about 1035 volts and exposed to an exposure source having a spectral output in the blue region of the visible spectrum to reduce the potential to about 250 volts. The imaging members were then erased by uniform exposure to an array of neon lamps with a peak output in the green region (about 520 nm) of the visible spectrum. This process was repeated 330 times in an ambient room temperature environment and the residual voltage cycle-up at the end of the 330th cycle was determined by an electrostatic voltmeter. The average residual voltage cycle-up of these imaging members of this invention was only 17 volts.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electrophotographic imaging member consisting essentially of a supporting substrate and only two selenium containing layers, one of said selenium containing layers being a charge transport layer having a thickness of between about 35 micrometers and about 75 micrometers substantially free of arsenic and tellurium and consisting essentially of selenium and a halogen selected from the group consisting of from about 4 parts per million by weight to about 13 parts per million by weight of a chlorine and from about 8 parts per million by weight to about 25 parts per million by weight of iodine and the other of said selenium containing layers being a charge generator layer having a thickness of between about 1 micrometer and about 20 micrometers and comprising selenium, about 5 percent to about 20 percent by weight tellurium, about 0.1 percent to about 4 percent by weight arsenic and a halogen selected from the group consisting of up to about 70 parts per million by weight of chlorine and up to about 140 parts per million by weight of iodine, one surface of said charge generator layer being in operative electrical contact with said charge transport layer and the other surface of said charge generator layer being exposed to the ambient atmosphere.

2. An electrophotographic imaging member in accordance with claim 1 wherein said halogen in said charge transport layer is selected from the group consisting of from about 6 parts per million by weight to about 10 parts per million by weight of chlorine and from about 13 parts per million by weight to about 20 parts per million by weight of iodine.

3. An electrophotographic imaging member in accordance with claim 2 wherein said halogen in said transport layer is chlorine.

4. An electrophotographic imaging member in accordance with claim 1 wherein said charge generator layer comprises from about 10 percent to about 13 percent by weight tellurium, from about 0.5 percent to about 2 percent by weight arsenic, less than about 14 parts per million by weight of chlorine and the remainder selenium.

5. An electrophotographic imaging member in accordance with claim 1 wherein said supporting substrate comprises a metal oxide layer.

6. An electrophotographic imaging member in accordance with claim 5 wherein said supporting substrate comprises a metal oxide layer on a metal layer.

7. An electrophotographic imaging member in accordance with claim 1 wherein said supporting substrate comprises a metal oxide layer and an adhesive layer interposed between said metal oxide layer and said charge generator layer.

8. An electrophotographic imaging process comprising providing an electrophotographic imaging member consisting essentially of a supporting substrate, and only two selenium containing layers, one of said selenium containing layers being a charge transport layer having a thickness of between about 35 micrometers and about 75 micrometers, substantially free of arsenic and tellurium and consisting essentially of selenium and a halogen selected from the group consisting of from about 4 parts per million by weight to about 13 parts per million by weight of a chlorine and from about 8 parts per million by weight to about 25 parts per million by weight of iodine and the other of said selenium containing layers being a charge generator layer having a thickness of between about 1 micrometer and about 20 micrometers comprising selenium, about 5 percent to about 20 percent by weight tellurium, about 0.1 percent to about 4 percent by weight arsenic and a halogen selected from the group consisting of up to about 70 parts per million be weight of chlorine and up to about 140 parts per million by weight of iodine, one surface of said charge generator layer being in operative electrical contact with said charge transport layer and the other surface of said charge generator layer being exposed to the ambient atmosphere, depositing a substantially uniform positive electrostatic charge on the said surface of said charge generator layer exposed to the ambient atmosphere, exposing said electrophotographic imaging member to an imagewise pattern of electromagnetic radiation to which said photoconductive charge generating layer is responsive whereby an electrostatic latent image is formed on said electrophotographic imaging member, developing said electrostatic image with electrostatically attractable toner particles to form a toner particle deposit in image configuration, and transferring said toner particle deposit to a receiving member.

9. An electrophotographic imaging process in accordance with claim 8 wherein said halogen in said charge transport layer is selected from the group consisting of from about 6 parts per million by weight to about 10 parts per million by weight of a chlorine.

10. An electrophotographic imaging process in accordance with claim 8 wherein said charge generator layer comprises from about 10 percent to about 13 percent by weight tellurium, from about 0.5 percent to about 2 percent by weight arsenic, less than about 14 parts per million by weight of chlorine and the raminder selenium.

* * * * *